US006000068A

United States Patent [19]

Chavis

[11] Patent Number: 6,000,068

[45] Date of Patent: Dec. 14, 1999

[54] PORTABLE COMMODE SEAT

[76] Inventor: Carolyn A. Chavis, P.O. Box 154, Lumberton, N.C. 28359

[21] Appl. No.: 09/151,124

[22] Filed: Sep. 10, 1998

[51] Int. Cl.[6] ..... A47K 13/14

[52] U.S. Cl. ..... 4/244.3; 4/239

[58] Field of Search ..... 4/239, 244.3

[56] References Cited

U.S. PATENT DOCUMENTS

| | | | |
|---|---|---|---|
| 972,269 | 10/1910 | Slough | 4/244.3 |
| 1,070,575 | 8/1913 | Batson et al. | 4/244.3 |
| 1,223,065 | 4/1917 | Meyer . | |
| 1,334,137 | 3/1920 | Delany | 4/239 |
| 1,379,374 | 5/1921 | Wagner . | |
| 1,563,236 | 11/1925 | Smith . | |
| 4,359,787 | 11/1982 | Shoji | 4/244.3 |
| 5,136,731 | 8/1992 | Caro et al. | 4/239 |

FOREIGN PATENT DOCUMENTS

| | | |
|---|---|---|
| 1051467 | 2/1959 | Germany . |

*Primary Examiner*—Charles E. Phillips
*Attorney, Agent, or Firm*—William B. Noll

[57] ABSTRACT

A portable and removable commode seat, for a first embodiment, comprises a commode seat and a series of extendable and foldable legs secured to the commode seat and extending therefrom. When the legs are extended generally vertically from the commode seat, the commode seat can be placed over a conventional commode and utilized without the person ever coming in contact with the underlying fixed commode. After use, the legs can be folded to extend adjacent the underside of the commode seat for convenient handling or storage. A modification thereof is commode seat having plural J-shaped supports to rest on and be supported by the conventional commode. In each case, a preferred feature is the provision of plural, thin, peelable and removable sheets of paper, or other suitable material, overlying the seating surface to allow the user thereof to expose a fresh and germ free surface when desired.

4 Claims, 4 Drawing Sheets

PORTABLE COMMODE SEAT

FIELD OF THE INVENTION

The present invention relates to a portable and removable commode seat and toilet accessories, and more particularly to a commode seat that is designed to be disposed and supported above a conventional fixed commode.

BACKGROUND OF THE INVENTION

People are well-aware of the normal conditions that exist in public restrooms. In short, the general public cannot depend on public restrooms to be clean and sanitary. In fact, experience indicates that public restrooms are not generally clean and sanitary throughout. It is not uncommon to find the floors of such public restrooms dirty and even wet with urine in and around urinal and commode areas. Further, toilet paper is often missing. Paper-type toilet seat covers are available in some public restrooms but on average one cannot rely on such commode seat covers being readily available in public restrooms. Even when available, commode seat covers are relatively thin sheets of paper, and frankly, the general public is skeptical as to whether such really affords any protection at all.

One of the problems faced by the general public in frequenting public restrooms is that of germs. Obviously, commode seats, upper commode rims and the commode in general will carry a host of germs and even bacteria. This is indeed a significant danger to the general public, especially older people, women and children.

The prior art offers some early attempts at meeting the needs noted above. This early prior art is reflected in the following patents:

a) U.S. Pat. No. 1,563,236, to Smith, teaches a portable toilet seat which utilizes a pair of U-shaped pivotal legs, pivotal from the underside of a circular toilet seat.

b) U.S. Pat. No. 1,379,374, to Wagner, relates a folding chair having a seat with a central commode opening, and four individually pivotal legs.

c) U.S. Pat. No. 1,223,065, to Meyer, discloses a portable toilet seat similar to that taught by Smith.

d) DE Pat. No. 1,051,467, to Elgin, teaches a child's fixed stool which is adapted to be positioned over a conventional toilet.

Despite these prior art efforts, there continues to be a need for a portable commode seat that can be easily carried by the general public when they are traveling, and which can be used in public toilet areas to avoid germs and other harmful bacteria and the like. The manner by which such needs are met will become clearer in the following specification.

SUMMARY OF THE INVENTION

The present invention relates to several embodiments for a commode seat that is designed to be supported over or on a conventional fixed commode. In a first embodiment supporting commode seat device includes a commode seat and a plurality of extendible legs secured to the commode seat and extending therefrom. Each leg includes a plurality of telescoping sections that permit the leg to be extended, retracted and adjusted in height. In addition, each leg is pivotally connected to the underside of the commode seat such that the leg can be folded to an inoperative position where the leg extends adjacent the underside of the commode seat. When all the legs of the self-supporting commode seat structure are in a folded position, the entire device can be easily and conveniently placed in a carrying bag or case for transport.

A modified commode seat of this invention comprises an oval or U-shaped seat having plural J-shaped supports on the underside of the seat, where such supports are positioned to rest on and engage a conventional toilet seat. With each embodiment a preferred arrangement is the provision of a plurality of peelable sheets of paper secured to the top side of the seat, such that a user thereof may quickly and easily remove the topmost sheet to present a clean fresh sheet.

It is therefore an object of the present invention to provide a first embodiment for a commode seat that can be stationed over a conventional fixed commode such that the portable commode seat does not come into contact with the fixed commode or any part thereof.

A further object of the present invention is to provide a portable commode seat that can be stationed over a commode at various heights above a support surface, thereby making the portable commode seat compatible with conventional fixed commodes of various heights.

Another object hereof is to provide a compact portable commode seat that offers each user thereof the knowledge and freedom of using the commode seat that is fresh and free of germs.

Still another object of this invention is the provision of a highly portable commode seat that is easy to carry for a traveler.

These and other objects will become apparent to those skilled in the art from a reading of the following specification, particularly when read in conjunction with the accompanying drawings.

DETAILED DESCRIPTION OF PREFERRED EMBODIMENTS

Figure 1:
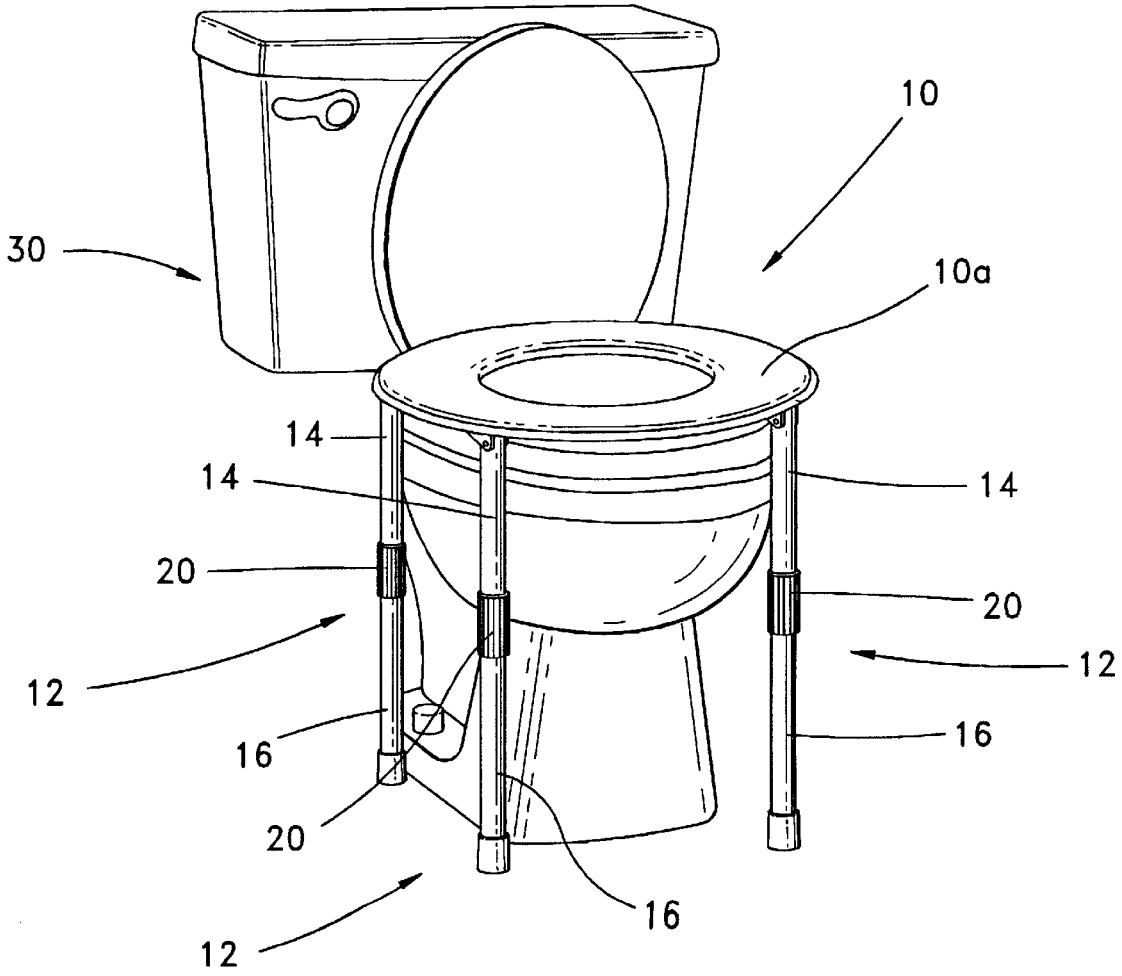
FIG. 1 is a perspective view of the commode seat of a first embodiment invention in a supported position over a conventional fixed commode.

The present invention is directed to a portable and transporable commode seat to be used in conjunction with a conventional toilet seat. The commode seat of this invention consists of several embodiments and is illustrated in FIGS. 1 through 8, where like reference numerals represent like features or components throughout the various views.

Figure 3:
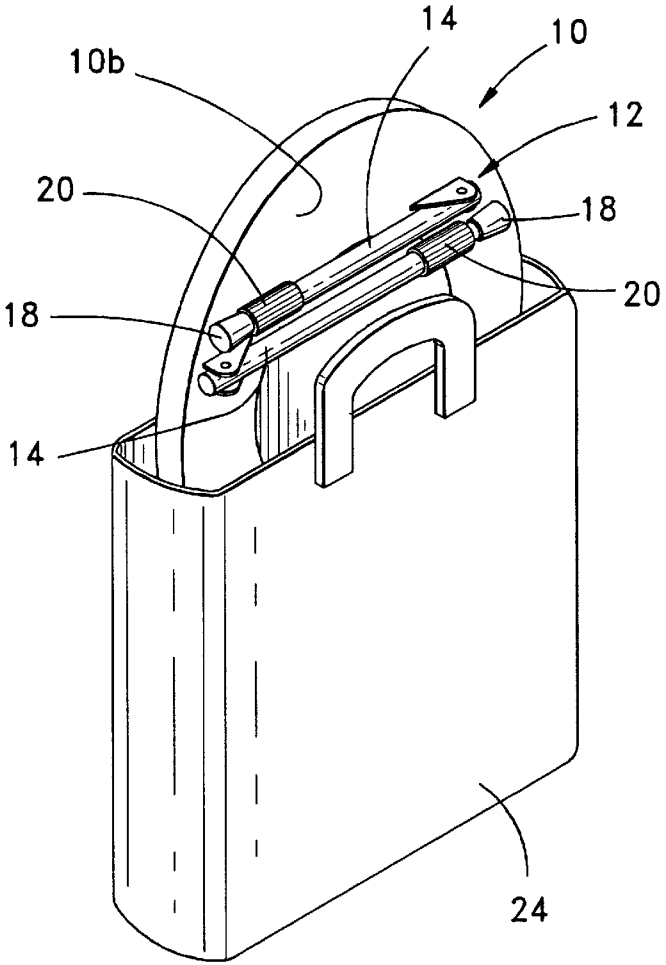
FIG. 3 is a perspective view of a carrying case that is designed to receive and hold the commode seat hereof.
Figure 2:
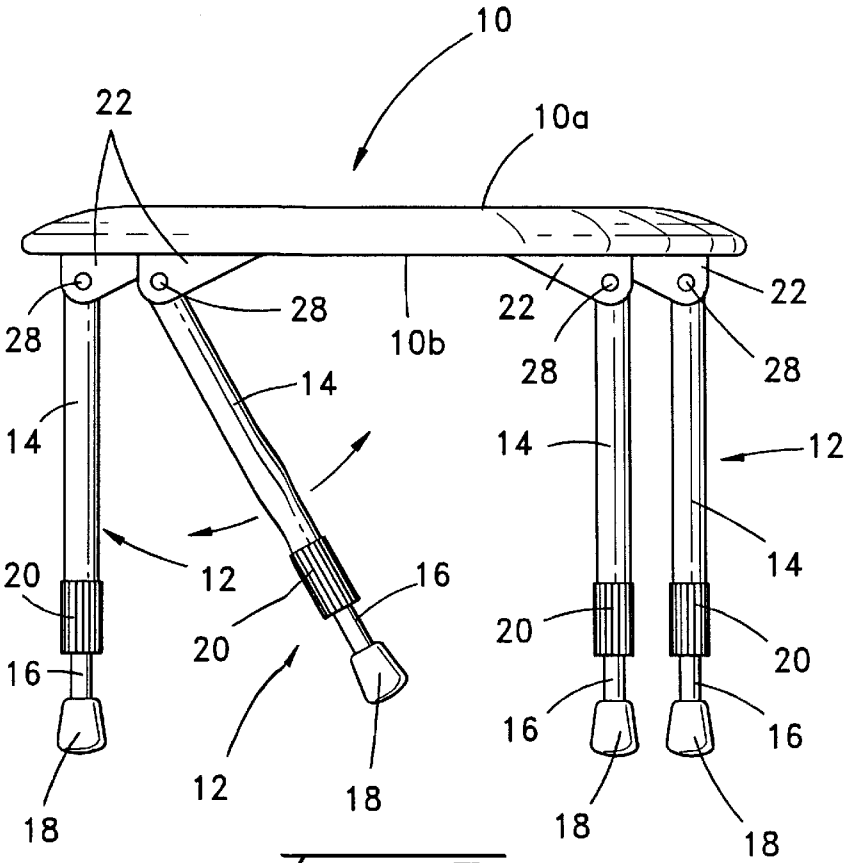
FIG. 2 is a side elevational view of the first embodiment for the commode seat of the present invention showing one leg thereof being pivoted towards its folded position.
Figure 7:
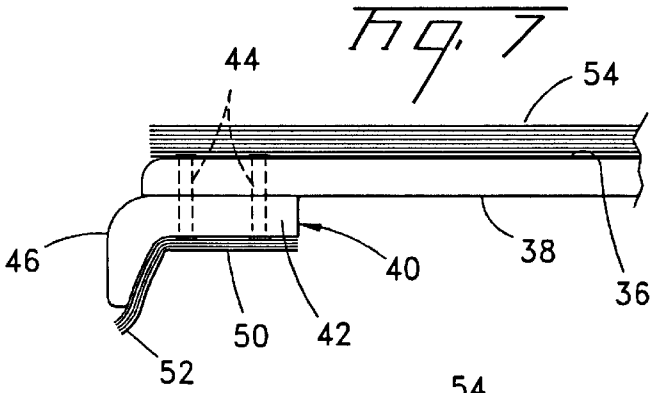
FIG. 7 is a partial, enlarged side view of the commode seat of FIG. 4.
Figure 5:
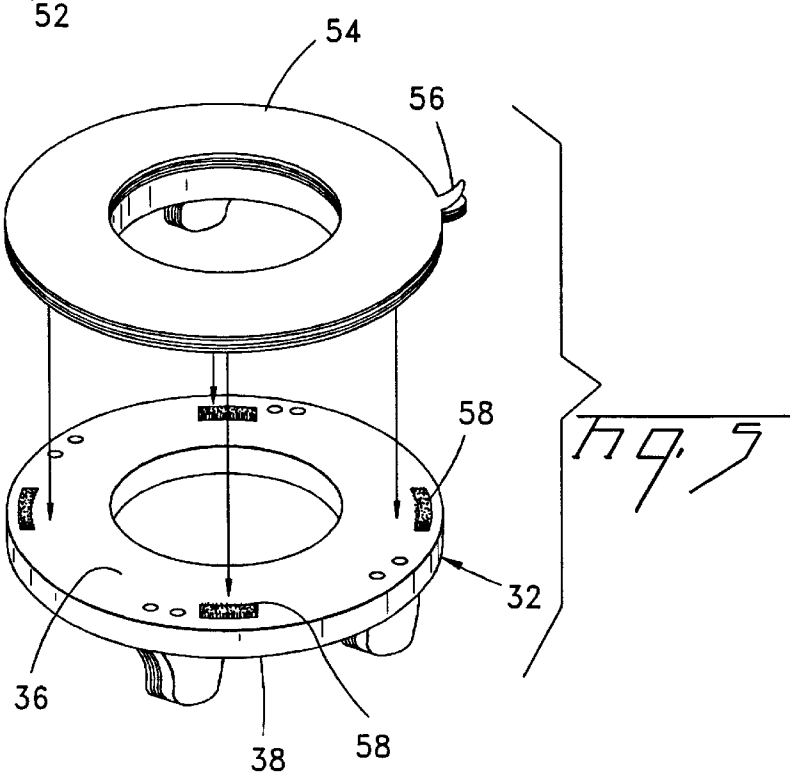
FIG. 5 is an exploded perspective view of the modified commode seat of FIG. 4, where plural sheets of readily peelable paper are positioned for temporary securement to the top surface of a commode seat.
Figure 4:
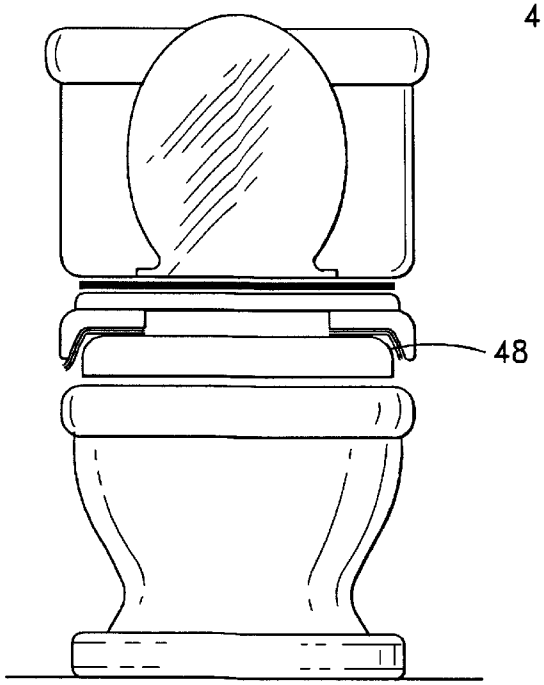
FIG. 4 is a front view of a modified commode seat according to this invention, where the modified commode seat is positioned on and supported by a conventional toilet seat.

Turning now to FIGS. 1 through 3, the portable commode seat of the present invention is shown therein and indicated generally by the numeral 10. The portable commode seat structure 10 includes a commode seat having an upper surface 10*a* and a lower surface 10*b*. The shape of the commode seat can be round, oval or any other desired Secured to the commode seat and extending therefrom is a series of legs, with each leg being referred generally by the numeral 12. Each leg 12 includes a pair of telescoping sections. More particularly, each leg 12 includes an upper section 14 and a lower section 16. The lower section 16 is confined within the upper section 14. The lower section 16 is movable from a retracted position (shown in FIG. 2) to an extended position (shown in FIG. 1). In order to securely lock the lower section 16 in a desired location with respect to the upper section 14, the upper section 14 about its lower portion is provided with a conventional locking collar 20. The locking collar 20 is designed such that it can be turned down to engage a portion of the lower section 16 and effectively lock the lower section 16 in a fixed postion with respect to the upper section 14. It will be appreciated that the lower section 16 of each leg can be adjustably stationed at an infinite number of extended positions. This, of course, allows the commode seat to be stationed at various heights above an underlying floor.

Formed in the lower terminal end of each lower section 16 is a rubber tip 18. The rubber tip 18 provides traction for the portable commode seat 10 and also provides for a relatively soft interface between the portable commode seat 10 and an underlying support structure.

An important feature of the commode structure 10 is that the same is designed to be portable such that the same can be conveniently carried by a traveler. In order to provide this portability, the commode structure 10 is designed such that the respective legs 12 can be folded to structure 10 is designed such that the respective legs 12 can be folded to assume an inoperative and carrying position. More particularly, the legs 12 are designed such that they can be pivoted to a folded postion where they lie adjacent the lower surface 10*b* of the commode seat (FIG. 3). To provide this folding capability, the commode seat is provided with a pair of gussets or flanges 22 at various points around the lower surface 10*b* of the commode seat. The gussets or flanges 22 are spaced apart so as to receive an upper terminal end of the upper section 14. More particularly, the gussets or flanges 22 are spaced apart to receive the upper section 14 of the leg and each such gusset pair is provided with a pivot pin 28 that extends through the upper section 14 of the leg 12 through the gussets 22 so as to pivotally connect each leg 12 to the commode seat.

It will be appreciated that various types of conventional fasteners can be used to connect the legs 12 to the commode such that the legs can be folded from a downwardly projecting operative mode to a folded inoperative storage mode. In this regard, it is well known and appreciated that such fasteners can be provided with an internal locking mechanism that will lock the respective legs 12 in either the operative extended position or in the folded inoperative position. Details of such fasteners and their internal locking mechanisms are not discussed herein in detail because such devices are well-known and appreciated by those skilled in the art.

The present invention also provides a portable carrying case 24. The carrying case 24 can be of any number of suitable designs that are sized and shaped so as to receive and hold the portable commode structure 10 when the legs assume the folded inoperative state. In the case of the design illustrated herein, the carrying case 24 is of a bag type case that includes an open top and a pair of upper side handles.

In use, the portable commode seat structure 10 can be carried by the traveler on vacations, business trips and on any occasion that requires travel from home. When the traveler frequents a public restroom, he or she will remove the portable commode seat from the carrying case 24 and erect the portable commode seat 10 over a conventional fixed commode that is shown in the drawings in FIG. 1 and indicated by the numeral 30. After the portable commode seat 10 has been removed from the carrying case 24, the legs 12 are pivoted from the folded position to a vertical or erect position where the legs extend generally perpendicular of the plane of the commode seat. The commode seat of the fixed commode 30 can be either raised or lowered. In FIG. 1, the portable commode seat device 10 is stationed over a closed seat that forms a part of the fixed commode 30. However, it is contemplated that in most cases the commode seat of the fixed commode will be raised prior to placing the portable commode seat 10 over the fixed commode 30.

To erect or place the portable commode seat 10 over the fixed commode 30, the height of the legs 12 can be adjusted such that the lower surface of 10*b* of the commode seat is spaced just above the bowl portion of the fixed commode 30. It will be appreciated, that in cases where the fixed commode 30 is relatively low, the legs 12 may not be required to be extended or if extension is required, they may only have to be extended a small degree. However, when the lower sections 16 of the respective legs 12 are extended, once an appropriate height is reached, the locking collars 20 are securely tightened so as to prevent the lower sections 12 from inadvertently telescoping back into the upper sections 14. It is appreciated that further saftey locks could be incorporated into the respective legs 12 by the provision of retractable pins that could be inserted within aligned openings formed in the upper and lower sections 14 and 16. The provision of such locking pins would serve to provide additional assurances that the respective upper and lower sections 12 and 14 would be fixed in an extended position.

Therefore, it is understood that once the portable commode seat 10 is placed over the fixed commode 30, that a person can then utilize the portable commode seat 10 of the present invention without ever having to make physical contact with the underlying fixed commode 30. Therefore, germs and bacteria that are disposed on and around the fixed commode 30 are not able to reach or come into contact with the person utilizing the portable commode seat 10 of the present invention.

Figure 8:
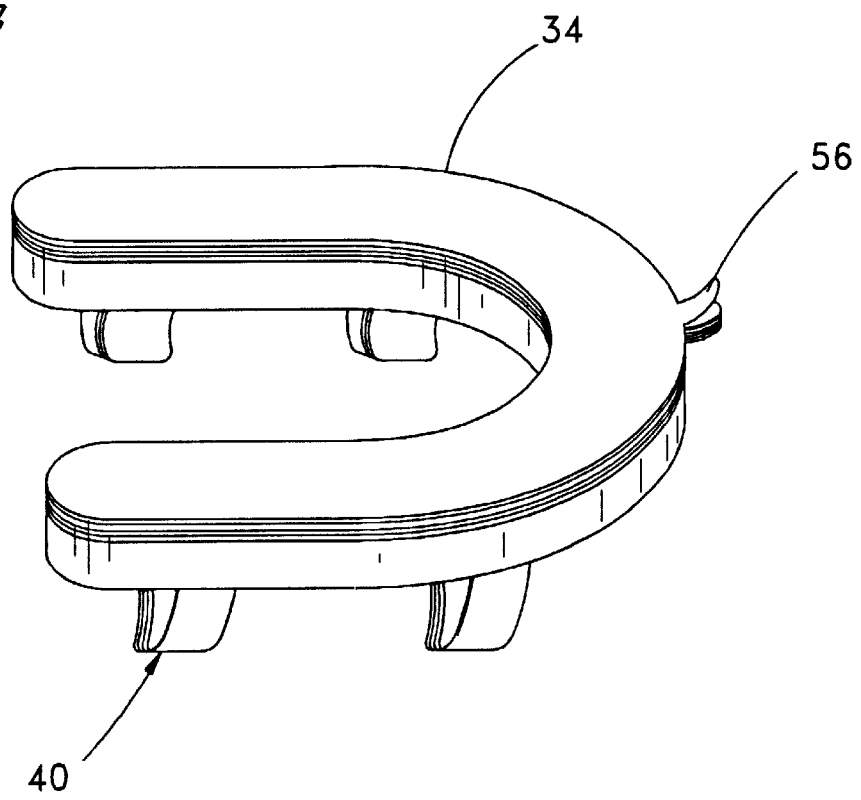
FIG. 8 is a perspective view of a further modification to the commode seat of FIGS. 5 and 6.
Figure 6:
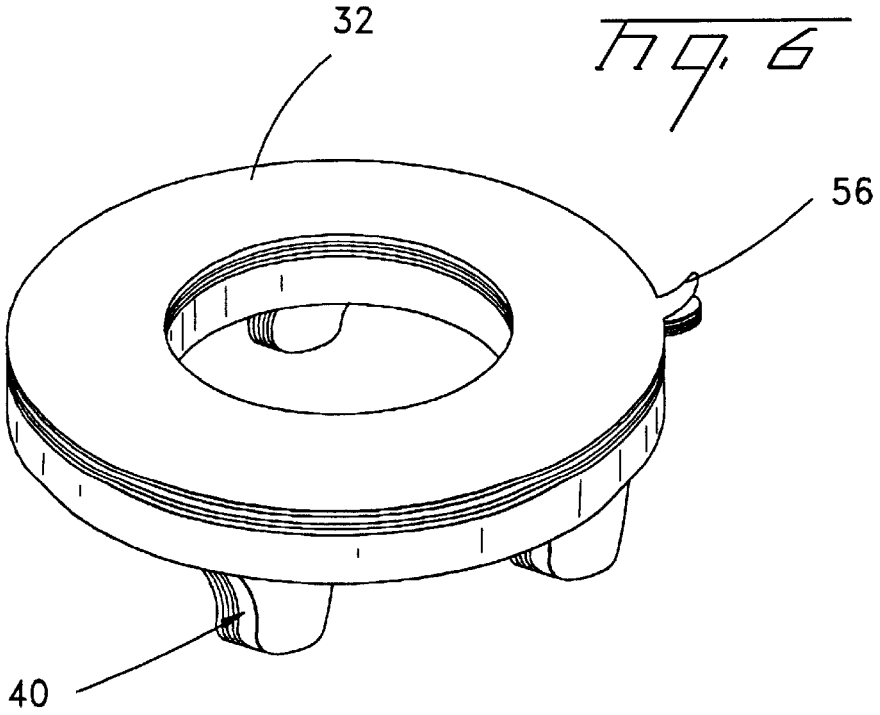
FIG. 6 is a perspective view of the assembled commode seat of FIG. 5.

FIGS. 4–8 illustrate modified commode seats which may take the form of a traditional oval seat 32 (FIGS. 5 and 6) or U-shaped seat 34 (FIG. 8). Each seat 32, 34, is characterized by an upper surface 36 and a lower surface 38, note particularly FIGS. 5 and 7, where the lower surface 38 mounts plural J-shaped support members 40. Such support members preferably four in number, comprise a first leg 42 configured to lie contiguous with and be secured to the lower surface 38, such as by fasteners 44, and a second curved leg 46. The respective curved legs 46 are contoured to be positioned to overlie and rest against an underlying conventional toilet seat 48, see FIG. 4. To ensure an environment free of germs, etc., the outer surface of legs 42, 46 may be provided with plural sheets peelable or removeable paper 50, or similar material having tab extensions 52 to facilitate manual removal thereof.

In similar fashion, the upper surface 36 may also be provided with plural sheets of peelable or removeable paper

54, or similar material, to allow the use thereof to present a clean and fresh seat free of germs, etc. Further, pull tabs 56 are provided to facilitate manual removal of the outermost sheet 54. To secure such plural sheets 54 to the upper surface 36, the lowermost said sheet, or a throw-away support, may include a hook and pile type fastener, known commercially as a VELCRO fastener, a trademark. Note particularly FIG. 5, which shows the upper surface 36 with complementary hook, and pile type fastening members 58 positioned about the upper surface 36.

By the provision of the short J-shaped support members 40, a compact commode seat is realized, allowing the user thereof to easily transport such commode seat in a travel case, such as illustrated in FIG. 3. To use, one merely has to peel the outermost layer of paper from each support member 40 and upper surface 36, to present germ free contact surfaces.

It is recognized that variations and modifications may be made to the respective commode seats thereof. Accordingly, no limitation is intended to be imposed thereon except as set forth in the appended claims.

I claim:

1. A portable commode seat for super imposition on a conventional toilet seating consisting of an oval, generally planar member having an opening therein, said portable commode seat comprising:

a) a generally planar member having an opening therein and having a top surface and a bottom surface;

b) a plurality of support member, having a J-shape in cross-section, each support member having the leg portion of the J attached to said bottom surface with the head portion of the J being oriented to receive a periphery of the toilet seat on a contact surface presented by each support member;

c) plural sheets of thin, peelable and removable sheets of paper on the contact surface for each said J-shaped support member; and d) plural, thin, peelable sheets of paper overlying said top surface for contact by the user of the seat, where the uppermost sheet of paper may be manually removed to expose a fresh said sheet.

2. The portable commode seat according to claim 1, wherein said respective plural sheets of paper are provided with tab extensions to allow easy removal of the outermost said sheet.

3. The portable commode seat according to claim 1, wherein said commode seat is U-shaped.

4. The portable commode seat according to claim 1, wherein the lowermost of said peelable and removable sheets is temporarily secured by hook and pile fastening means to said top surface.

* * * * *